US007314101B2

(12) United States Patent
Beach

(10) Patent No.: US 7,314,101 B2
(45) Date of Patent: Jan. 1, 2008

(54) INNER CORE BARREL HEAD ASSEMBLY FOR CORE TUBE WITHIN A DRILL STRING

(75) Inventor: Andrew Beach, Boddington (AU)

(73) Assignee: 2iC Australis Pty Ltd, Canning Vale, WA (AU)

( * ) Notice: Subject to any disclaimer, the term of this patent is extended or adjusted under 35 U.S.C. 154(b) by 230 days.

(21) Appl. No.: 10/478,460

(22) PCT Filed: May 22, 2002

(86) PCT No.: PCT/AU02/00644

§ 371 (c)(1),
(2), (4) Date: Apr. 30, 2004

(87) PCT Pub. No.: WO02/095183

PCT Pub. Date: Nov. 28, 2002

(65) Prior Publication Data

US 2004/0216927 A1 Nov. 4, 2004

(30) Foreign Application Priority Data

May 23, 2001 (AU) ..... 48002/01

(51) Int. Cl.
*E21B 25/02* (2006.01)

(52) U.S. Cl. ..... 175/246; 175/244; 175/251

(58) Field of Classification Search ..... 175/244, 175/246, 251
See application file for complete search history.

(56) References Cited

U.S. PATENT DOCUMENTS 3,225,845 A * 12/1965 Koontz et al. ..... 175/236
3,543,870 A * 12/1970 Martinsen ..... 175/60
3,565,192 A * 2/1971 McLarty ..... 175/246
3,724,568 A * 4/1973 Koepke ..... 175/247
4,664,204 A * 5/1987 Nenkov et al. ..... 175/44
4,800,969 A * 1/1989 Thompson ..... 175/246
4,930,587 A * 6/1990 Young et al. ..... 175/251
5,482,123 A * 1/1996 Collee ..... 175/58

(Continued)

FOREIGN PATENT DOCUMENTS

EP 4020207 1/1992

(Continued)

*Primary Examiner*—David Bagnell
*Assistant Examiner*—Shane Bomar
(74) *Attorney, Agent, or Firm*—Clark & Elbing LLP

(57) ABSTRACT

Inner core barrel head assembly (10) includes an upper latch body (24), a plurality of latching balls (26) which are retained in the latch body (24) and a locking sleeve (28) disposed within the latch body (24). The sleeve (28) has an outer circumferential latching surface (30) of a first outer diameter and an outer circumferential release surface (32) of a second outer diameter smaller than the first outer diameter. The locking sleeve is axially moveable relative to the upper latch body (24) between a latching position and a release position. In the latching position, the latching surface (30) is in radial alignment with the balls (26), forcing the balls (26) radially outwardly into a latch seat (12) provided on a core barrel (20) attached to a lower end of a drill rod (14). This latches the assembly (10) to the core barrel preventing withdrawal. In the release position, release surface (32) is in radial alignment with the balls (26) allowing the balls (26) to move radially inwardly out of engagement with the latch seat (12).

14 Claims, 7 Drawing Sheets

U.S. PATENT DOCUMENTS

| | | | | |
|---|---|---|---|---|
| 5,934,393 | A * | 8/1999 | Marshall | 175/236 |
| 6,059,053 | A * | 5/2000 | McLeod | 175/258 |
| 6,089,335 | A * | 7/2000 | Able | 175/246 |
| 6,216,804 | B1 * | 4/2001 | Aumann et al. | 175/236 |
| 6,659,204 | B2 * | 12/2003 | Aumann et al. | 175/244 |
| 2002/0033281 | A1 * | 3/2002 | Aumann et al. | 175/244 |

FOREIGN PATENT DOCUMENTS

| | | |
|---|---|---|
| SU | 791926 | 4/1978 |
| SU | 1057673 | 6/1980 |
| SU | 1117394 | 4/1983 |
| SU | 1439204 | 1/1987 |
| SU | 1492015 | 10/1987 |
| SU | 1609951 | 11/1988 |

* cited by examiner

INNER CORE BARREL HEAD ASSEMBLY FOR CORE TUBE WITHIN A DRILL STRING

CROSS-REFERENCE TO RELATED APPLICATIONS

This application is the National Stage of International Application No. PCT/AU02/00644, filed May 22, 2002, which was published in English under PCT Article 21(2). This application also claims benefit of Australian Provisional Application No. 48002/01, filed May 23, 2001.

FIELD OF THE INVENTION

The present invention relates to an inner core barrel head assembly.

BACKGROUND OF THE INVENTION

In core drilling, a core tube is suspended inside a drill string for receiving a core sample of the ground being cut by the drill. The core tube is coupled to a lower end of an inner core barrel head assembly which is releasably locked inside the drill string. In order to retrieve a core sample received in a core tube, an overshot is lowered through the drill string at the end of a wire line to engage a spear point attached to an upper end of the inner core barrel head assembly. Similarly, once the core is extracted from the core tube, the inner core barrel head assembly is lowered into the drill string using the overshot and wire line.

Typically an inner core barrel head assembly is provided with a pair of spring loaded latch dogs that engage in an annular latch seat formed on the inside surface of the drill string. This seat is often formed as a increased inner diameter portion of an adaptor coupling used for coupling a lower most drill rod of a drill string to a core barrel outer tube. By pulling on the wire line, one part of the inner core barrel head assembly moves relative to another causing latch dogs to pivot inwardly toward each other and disengage from the latch seat. Once this occurs, further pulling on the wire line causes the head assembly to be pulled from the drill string. However, occasionally the latch dogs become jammed and are unable to be disengaged from the latch seat. In such instances, the only way the head assembly can be removed is to pull the drill string. This is an extremely costly exercise because of the time involved in breaking out the individual drill rods and subsequent re-assembly and the corresponding loss of drill time.

Several attempts have been made to overcome this problem such as in U.S. Pat. No. 6,089,335 (Able) and U.S. Pat. No. 5,934,393 (Marshall). In Able, the latch dogs are inverted with respect to the common configuration so that a main pivot point of the latch dogs is disposed upstream of their corresponding latching face. In Marshall, the latch dogs are in their traditional configuration but a mechanical link is provided between the free ends of the latch dogs to pivot them inwardly toward each other and thus away from the latch face by upward pulling on the wire line.

SUMMARY OF THE INVENTION

It is an object of the present invention to provide an inner core barrel head assembly which provides an alternate form of latching mechanism for latching into a drill string.

According to the present invention there is provided an inner core barrel head assembly for releasably latching in a latch seat provided in a drill string, said assembly including at least:

an upper latch body;

a plurality of latching elements retained in said latched body; and a locking sleeve dispersed within said upper latch body, said locking sleeve having a latching surface of a first outer diameter and a release surface of a second outer diameter less than said first outer diameter, said locking sleeve axially moveable relative to said upper latch body between a latching position and a release position, said latching position characterised by said latching elements being in abutment with said latching surface forcing said latching elements to move radially outwards where said latching elements can engage said latch seat to latch said assembly to said drill string, and said release position characterised by said release surface juxtaposed radially inside of said latching elements to allow said latching elements to move radially inwards out of engagement with said latch seat.

Preferably said latch elements are in the form of balls.

Preferably said latching seat includes a tapered outer surface portion between said latching surface and said release surface.

Preferably said assembly includes a detent for releasably holding said locking sleeve in said locking position.

Preferably said detent includes a resilient ring through which said locking sleeve can be selectively pushed and pulled.

Preferably said assembly includes a release sleeve slidably coupled to said locking sleeve to enable said release sleeve and locking sleeve to move axially relative to each other for a first distance.

Preferably said assembly includes a coupling member extending radially through said locking sleeve and engaged with said release sleeve.

Preferably one of said locking sleeve and release sleeve is provided with a pair of axially extending slots through which said coupling member passes.

Preferably said coupling member is a pin.

Preferably said assembly is formed with an internal axial passage.

Preferably said assembly includes a first valve for opening and closing said internal axial passage.

Preferably said assembly includes a first bias means biasing said first valve to an open position whereby fluid can flow through said internal axial passage.

Preferably said first valve includes a first moveable stop disposed in said release sleeve; a seat formed at an upstream end of said locking sleeve for seating said stop to close said internal axial passage, and said coupling member, wherein said first bias means acting to push said coupling member in an upstream direction to lift said stop from said seat thereby biasing said first valve in said open position.

Preferably said first bias means includes a first spring disposed about said locking sleeve and between a spring seat formed on an internal inner surface of said upper latch body and a downstream end of said release sleeve.

Preferably said assembly includes:

a lower latch body coupled between said upper latch body and a core tube, said lower latch body provided with an axial bore which forms part of said inner axial passage and a second valve operable for opening and closing said bore.

Preferably said second valve includes a second moveable stop, and a bypass seat formed between said closing seat and said upper latch body, wherein said second stop is seated on said bypass seat fluid can flow about said second stop and through said bypass seat.

Preferably said assembly includes a retaining ring about an outer surface of said upper latch body through which said latching members can partially extend.

Preferably said assembly includes a landing shoulder axially spaced from said latching members for seating on an upstream side of a landing ring retained within said drill string.

BRIEF DESCRIPTION OF THE DRAWINGS

An embodiment of the present invention will now be described by way of example only with reference to the accompanying drawings in which.

DETAILED DESCRIPTION OF PREFERRED EMBODIMENT

Figure 1:
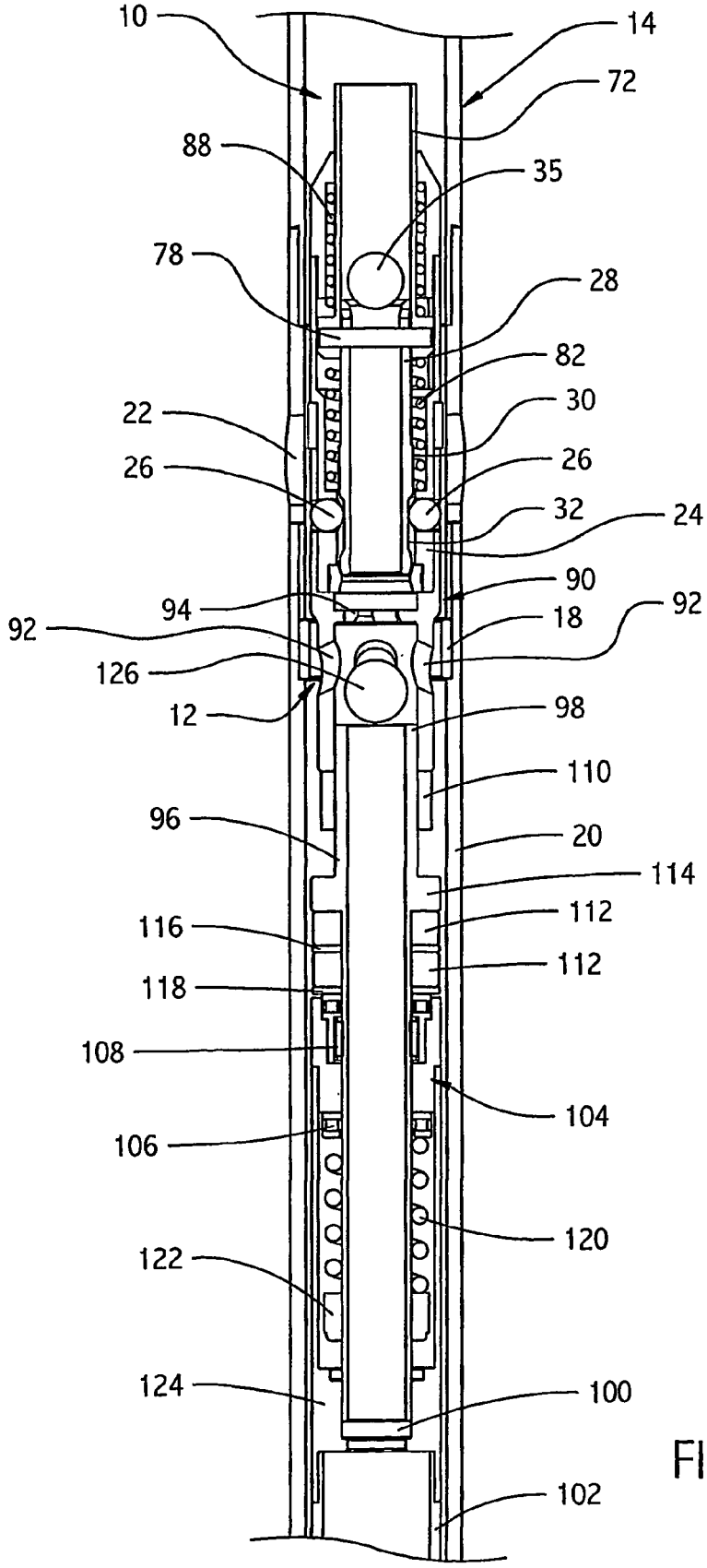
FIG. 1 is a section view of an inner core barrel head assembly in accordance with an embodiment of the present invention.

Referring to the accompanying drawings there is shown an inner core barrel head assembly 10 for releasably latching in a latch seat 12 of a drill string 14. In this embodiment, the latch seat 12 is formed by a lower annular face 16 of a landing ring 18 clamped between a core barrel 20 and an adaptor reamer 22 of the drill string 14. The core barrel 20, landing ring 18 and adaptor reamer 22 are standard component of a drill string and do not require any modification to accommodate the present assembly 10.

Figure 4:
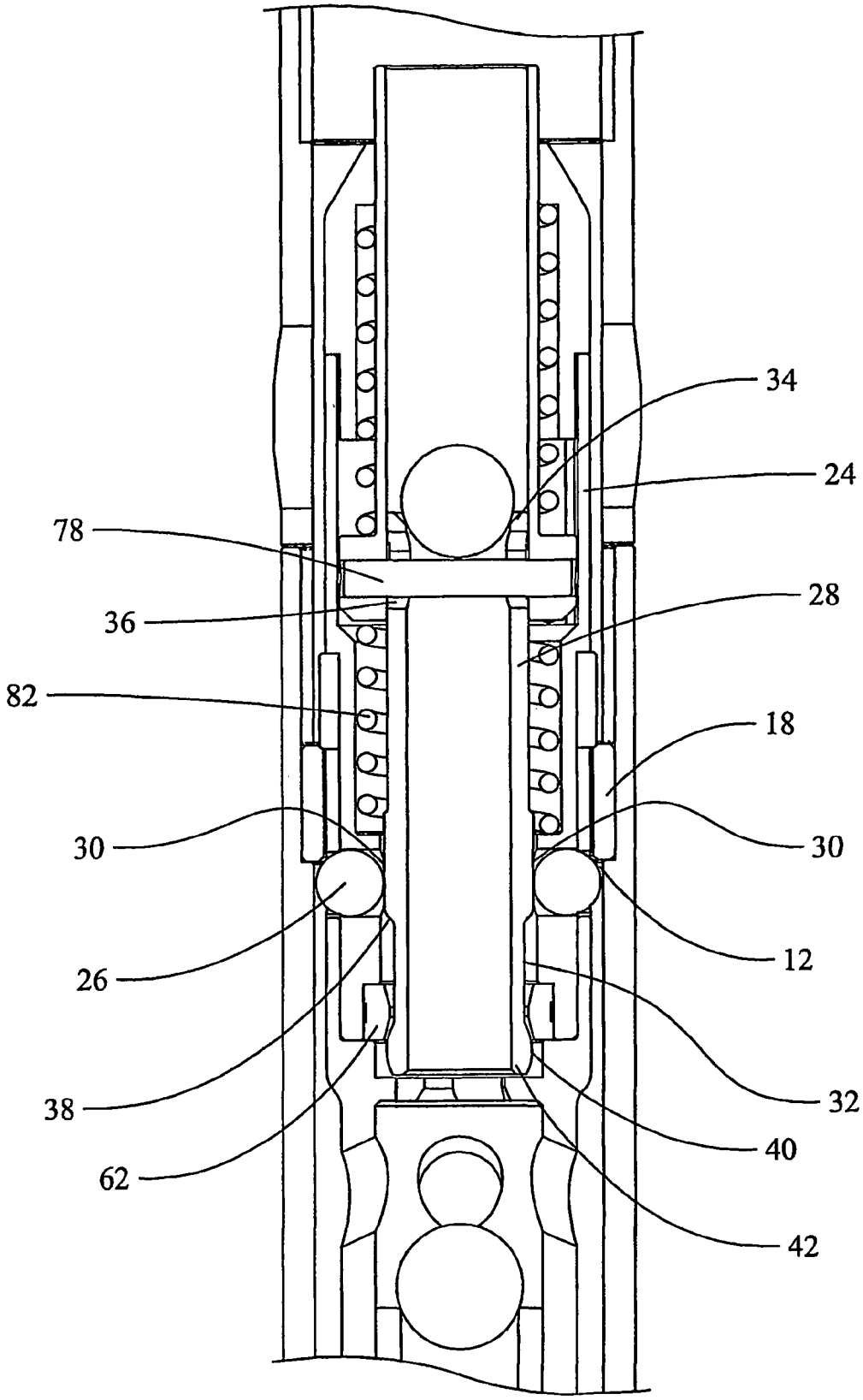
FIG. 4 is a view of the head assembly when initially latched to the drill string.
Figure 5:
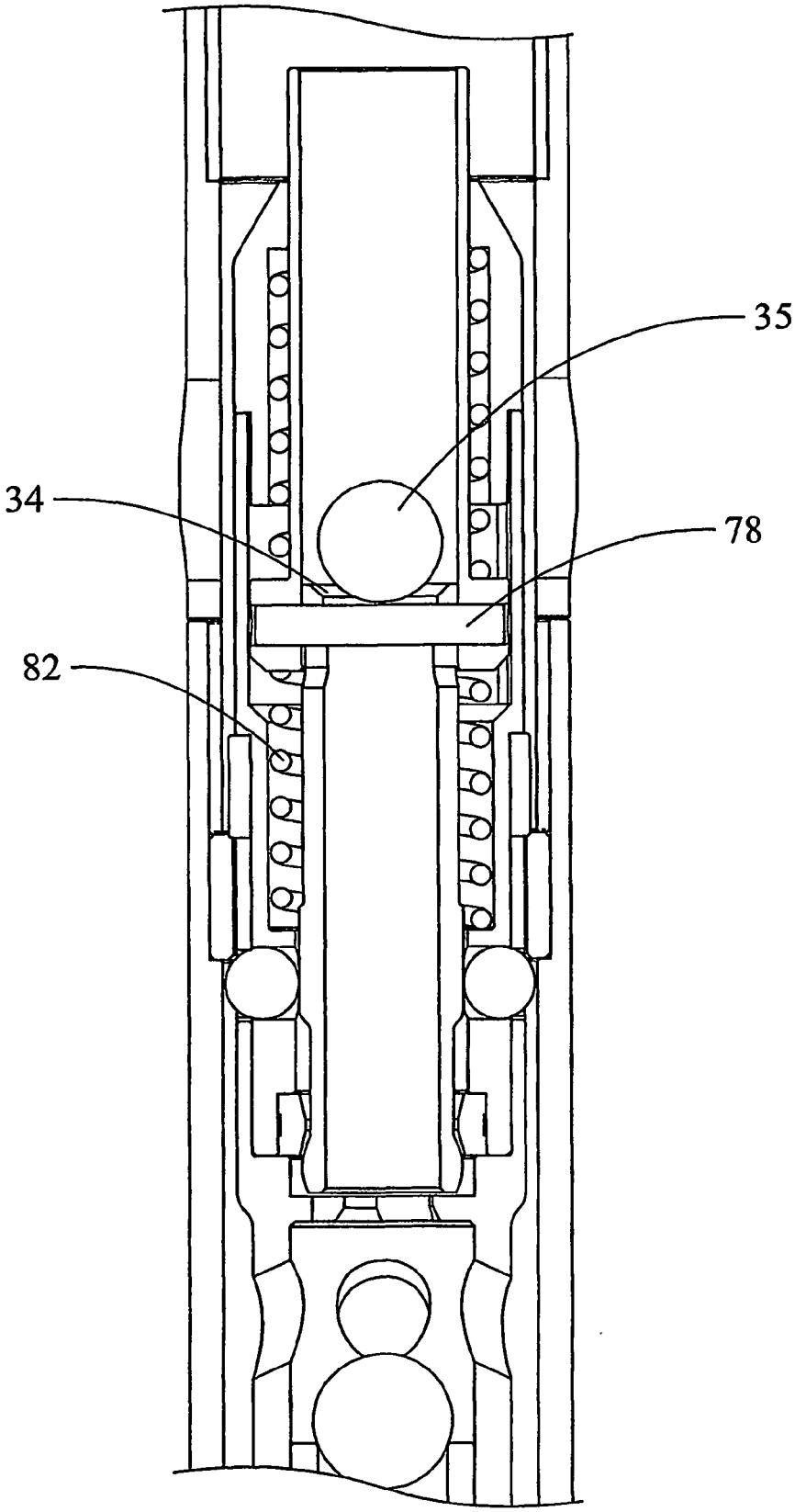
FIG. 5 is a view of the head assembly after latching.
Figure 6:
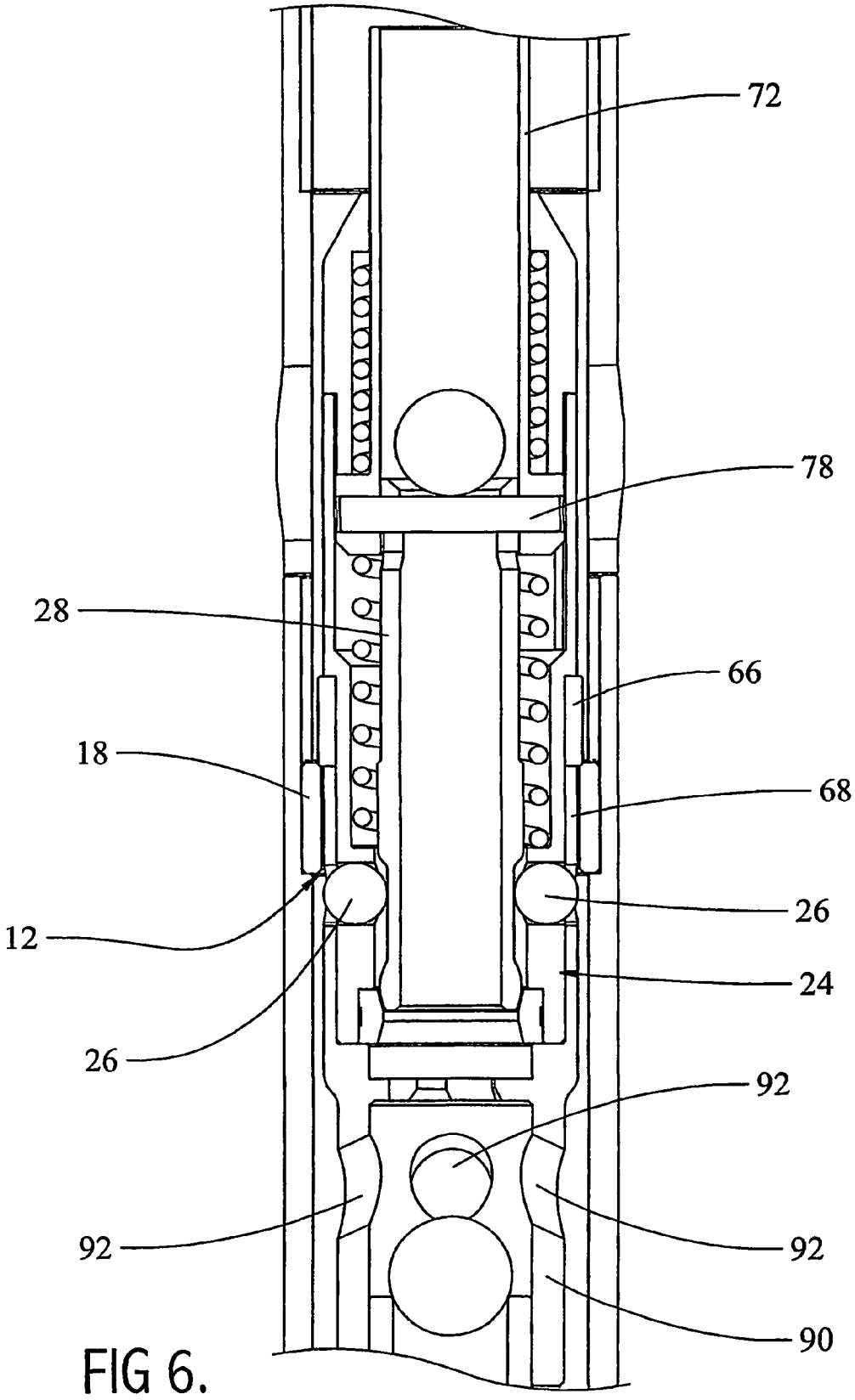
FIG. 6 is a view of the head assembly when being retracted from the drill string.

With specific reference to FIG. 1, the assembly 10 includes an upper latch body 24, a plurality of latching members in the form of balls 26 which are retained in the upper latch body 24 and a locking sleeve 28 disposed within the upper latch body 24. The locking sleeve 28 has an outer circumferential latching surface 30 a first outer diameter and an outer circumferential release surface 32 of a second outer diameter which is smaller than the first outer diameter. The locking sleeve 28 is axially moveably relative to the upper latch body 24 between a latching position and a release position. The latching position, shown most clearly in FIGS. 4 and 5, is characterised by the latching surface 30 being in radial alignment with the balls 26 thereby forcing the balls 26 radially outwardly into the latch seat 12. This latches the assembly 10 to the core barrel 20 preventing withdrawal of the assembly 10. The release position, depicted in FIG. 6, is characterised by the release surface 32 being in radial alignment with the balls 26 allowing the balls 26 to move radially inwardly out of engagement with the latch seat 12.

Figure 2:
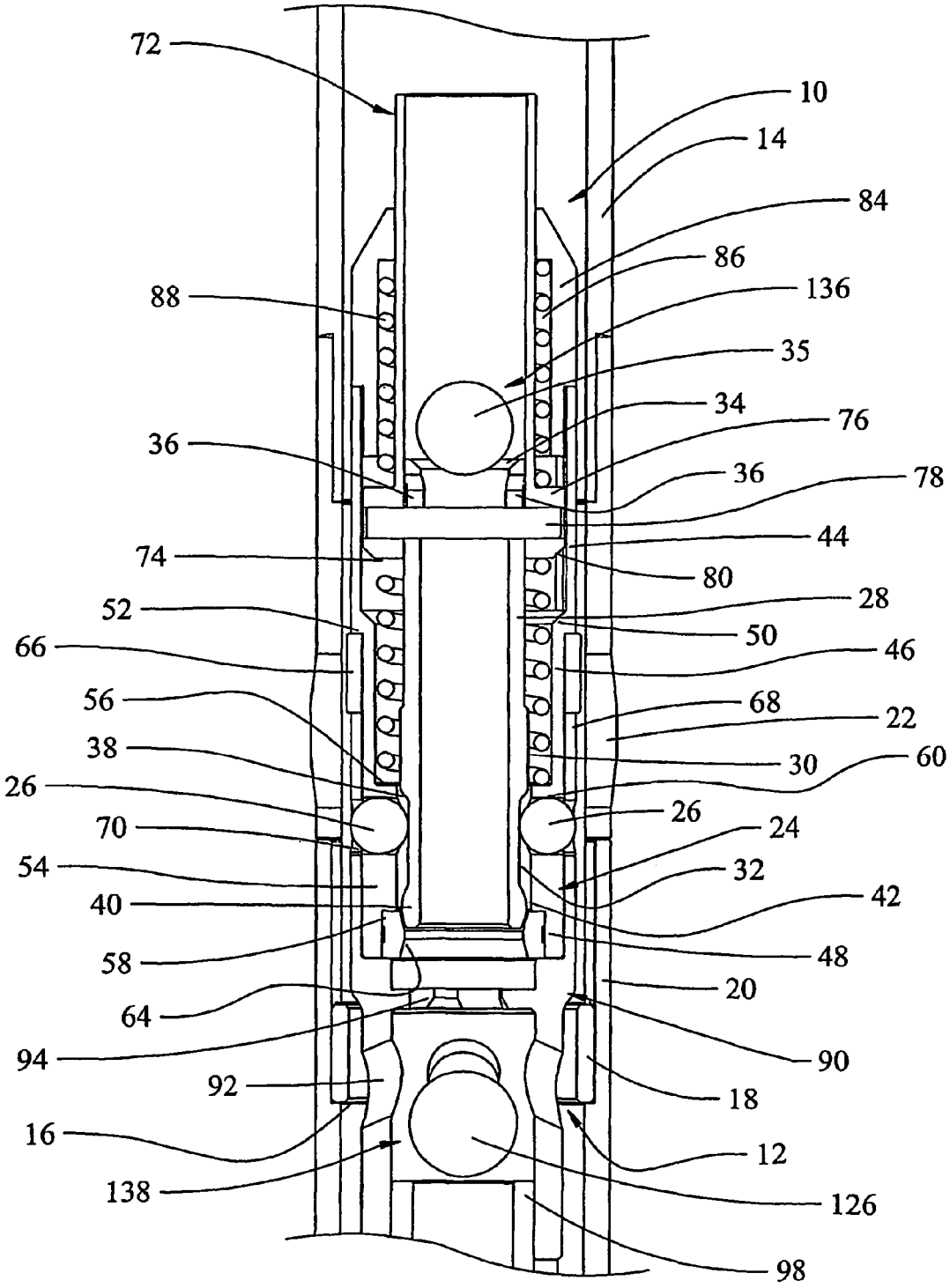
FIG. 2 is an enlarged view of a portion of the head assembly prior to latching in a drill string.

Referring to FIG. 2, it can be seen that locking sleeve 28 is in the form of an elongated hollow tube. An upperstream end of the sleeve 28 is formed with a bevelled annular surface which forms a valve seat 34. This seat 34 decreases in diameter and direction from the upstream end to the downstream end of the sleeve 28. The seat 34 seats a moveable stop in the form of valve ball 35, the function of which is described later. A pair of diametrically opposed axially extending slots 36 are formed in the sleeve 28 beneath the seat 34. Latching surface 30 is formed intermediate the length of the sleeve 28 as an increased outer diameter portion. Formed contiguously with the latching surface 30 in a downstream direction is a tapered surface portion 38 that leads to the release surface 32. In turn the release surface 32 leads to a convex outer surface portion 40 at a downstream end 42 of the sleeve 28.

The upper latch body 24 is also in the form of a hollow tube having three contiguous portions, an upperstream portion 44, intermediate portion 46 and downstream portion 48. The upperstream portion 44 has a larger inner diameter and larger outer diameter than the adjoining intermediate portion 46. On the inside of the upper latch body 24 there is a circumferential tapered surface 50 joining the inner surface of the upper stream portion 44 to the inner surface of the intermediate portion 46. However on the outside of the body 24 there is a stepped shoulder 52 forming the transition between the upperstream portion 44 and intermediate portion 46.

The intermediate portion 46 and downstream portion 48 have the same outer diameter.

However there is a stepped decrease in the inner diameter of the downstream portion 48 creating a thickened portion 54 which is bound at an upstream end by a spring seat 56 and at a downstream end by detent seat 58. A plurality of radial holes 60 are formed in the thickened portion 54 for accommodating respective balls 26. The holes 60 are formed of a diameter slightly greater than that of the balls 26.

A resilient detent ring 62 is seated in the detent seat 58. The detent ring 62 is formed with a generally convex inner surface 64. The combination of detent ring 62 and convex surface 40 forms a detent which releasably locks the position of the sleeve 28.

A landing shoulder 66 in the form of an annular ring is seated about the outer surface of intermediate portion 46 against the shoulder 52. Also seated on the outer surface of the intermediate portion 46 and extending to the downstream portion 48 is a retaining ring 68. The retaining ring is also provided with a plurality of holes 70 that register with the holes 60 but are of a diameter smaller than the diameter of the balls 26. In this way, the retaining ring 68 prevents the balls 26 from falling out of the body 24. The retaining ring 68 can be made from an elastomeric material.

A release sleeve 72 is slidably coupled to an upstream end of the locking sleeve 28. The release sleeve 72 is in the form of a hollow tube having a constant inner diameter but having an increased outer diameter at a downstream end 74 creating a thickened portion 76. A coupling member in the form of a pin 78 extends radially through the slots 36 of the locking sleeve 28 and engages at opposite ends with the thickened portion 76 of the release sleeve 72. This coupling allows the locking sleeve 28 and release sleeve 72 to move axially relative to each other by distance equal to the length of the slots 36 minus the diameter of the pin 78. However once the limit of this travel has been reached, the sleeves 28 and 72 move together if subjected to a force acting in a constant direction.

A circumferential bevel 80 is formed inwardly from an outer diameter of the thickened portion 76 at the downstream end 74. The surface 80 is of an angle complimentary to the angle of the taper of surface 50 formed between the upper stream portion and intermediate portion 46 of the upper latch body 24.

A first bias element in the form of spring 82 is retained about the outer surface of the sleeve 28 and between the thickened portion 76 of release sleeve 72 and the seat 56 formed in the upper latch body 24. The spring 82 is preloaded so as to bias the release sleeve 72 to move axially away from the locking sleeve 28. The release sleeve 72 is retained within the assembly 10 by a end cap 84 which is screwed into an upstream end of the upstream portion 44 of the upper latch body 24. The cap 84 extends axially inside the upper portion 44 and is formed with an annular stop face 86 at a downstream end that can abut with the thickened portion 76 preventing any further axial motion of the release sleeve 72 away from the sleeve 28. Apart from an upstream end of the cap 84, the inner diameter of the cap 84 is a significantly greater diameter than the outer diameter of release sleeve 72 to create an annular space 87 for seating a second bias element in the form of spring 88. The spring 88 is also preloaded and acts to bias the release sleeve 72 toward the locking sleeve 28. It is possible, though not necessary, for the spring 88 to be a lighter or weaker spring than spring 82. However typically springs 82 and 88 would be identical.

Lower latch body 90 is threadingly coupled at its upstream end to the outer surface of the downstream portion 48 of the upper latch body 24. A plurality of ports 92 are formed in the latch body 90 intermediate of its length A bypass seat 94 is retained in the lower latch body 90 upstream of port 92.

An elongated hollow spindle 96 is threadingly coupled at its upstream end 98 to an inside surface of the lower latch body 90 and, at its downstream end 100 to a conventional core tube 102. The spindle 96 is of conventional construction except for the bearing assembly 104 intermediate its length. In a conventional spindle, thrust bearings are provided about the outer circumference of the spindle 96 to provide axial support to spindle 96. However, in the present embodiment, the bearing assembly 104 comprises the combination of thrust bearings 106 and a needle bearing assembly 108 to provide radial support to the spindle 96.

As in a conventional spindle 96, a lock nut 110 is threadingly coupled to an outer surface near the upstream end 98 of the spindle 96 to lock it to the lower latch body 90. Shut off valve rubbers 112 are disposed about the spindle 96 downstream of a integral radially extending flange 114 formed about the spindle 96. The shut of rubbers are spaced by a washer 116, and a further washer 118 separates the lower most shut off rubber 112 from the combined needle and thrust beating assembly 104.

A spring 120 disposed about the spindle 96 biases the bearing assembly 104 in the upperstream direction. The force exerted by the spring 120 can be adjusted by turning a lock nut 122 which is threaded onto the outer surface of the spindle 96 and on which a downstream end of the spring 120 sits. The spring 120 and lock nut 122 are housed with a spindle bearing housing 124 which in turn is threadingly coupled to the bearing housing 104.

A freely moveable stop in the form of ball 126 is retained within the lower latch body 90 between the bypass seat 94 and the upperstream end 98 of the spindle 96 which forms a valve seat.

Figure 7:
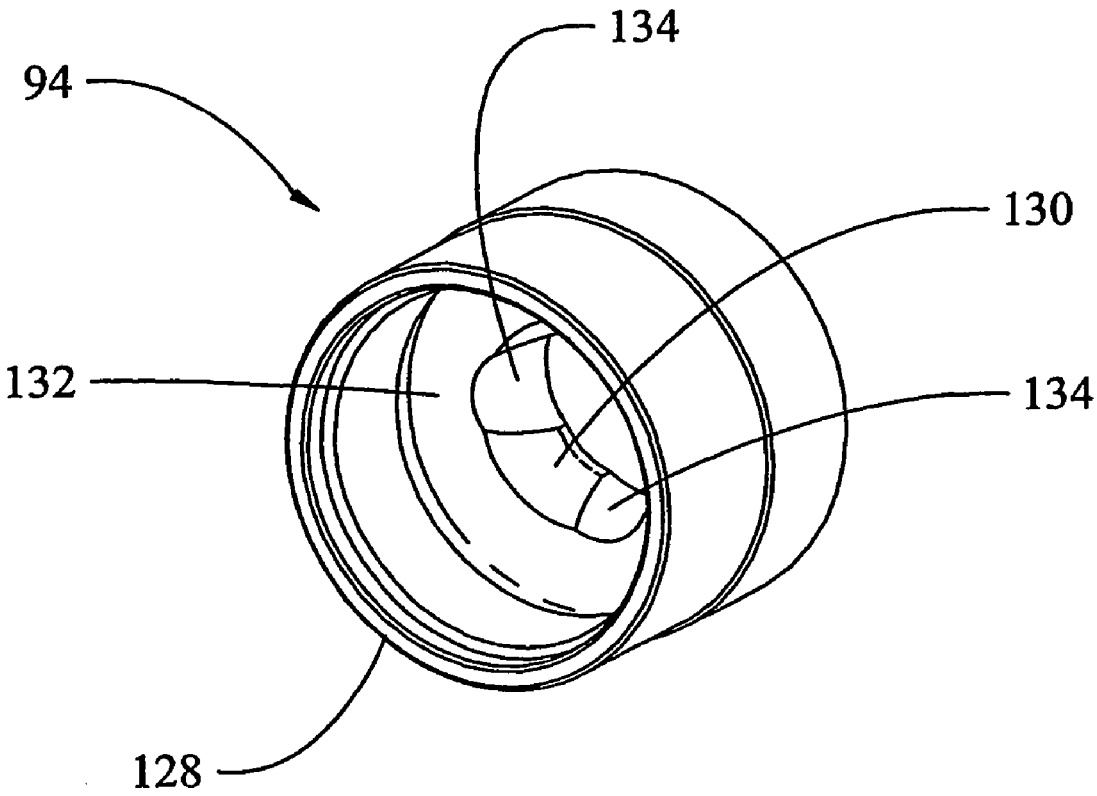
FIG. 7 is an isometric view of a bypass valve seat incorporated in the head assembly.

FIG. 7 illustrates in detail the bypass seat 94. The seat 94 is in the form of a ring having a first portion 128 with an inner diameter larger than the diameter of the ball 126 and a second portion 130 with an inner diameter smaller than the diameter of the ball 126. There is a stepped transition between the inner diameters of portions 128 and 130 forming an annular surface 132 on which the ball 126 can seat. A plurality of cut outs or scallops 134 are formed in, and extend axially for the whole length of, the inner surface of portion 130. The scallops 134 are configured so that when the ball 126 is seated on the surface 132 fluid can flow around the ball 126 and through the scallops 134.

The operation of the assembly 10 will now be described with particular reference to FIGS. 2-6.

FIG. 2 illustrates the top end of the inner core tube head assembly 10 as it descends down drill string 14 toward landing ring 18. Typically, a spearhead point (not shown) would be attached to the upstream end of sleeve 72 which in turn would be coupled to an overshot and wire line (both not shown) for lowering the assembly 10 through (and subsequently retrieving the assembly 10 from) the drill rod 14. The assembly 10 is formed with an inner axial passage constituted by the interior surfaces of the sleeve 72, sleeve 28, bypass seat 94, lower latch body 90, ports 92 and spindle 96. The combination of the ball 35, seat 34 and pin 78 form a first valve 136 while the combination of the ball 126, bypass seat 94 and valve seat 98 form a second valve 138. Typically, the drill rod 14 would be filled with a liquid such as water or drilling muds. As the assembly 10 descends, the valves 136 and 138 are open allowing the liquid to pass through the internal axial passageway. This arises because the fluid itself pushes the ball 35 from the seat 34, and the ball 126 onto the bypass seat 94. The flow of liquid through the internal axial passage assists in increasing the speed of descent of the assembly 10 through the drill rod 14. During the descent, the locking sleeve 28 is juxtaposed relative to the upper latch body 24 so that the release surface 32 is radially inside of the balls 26, as depicted in FIG. 2.

Figure 3:
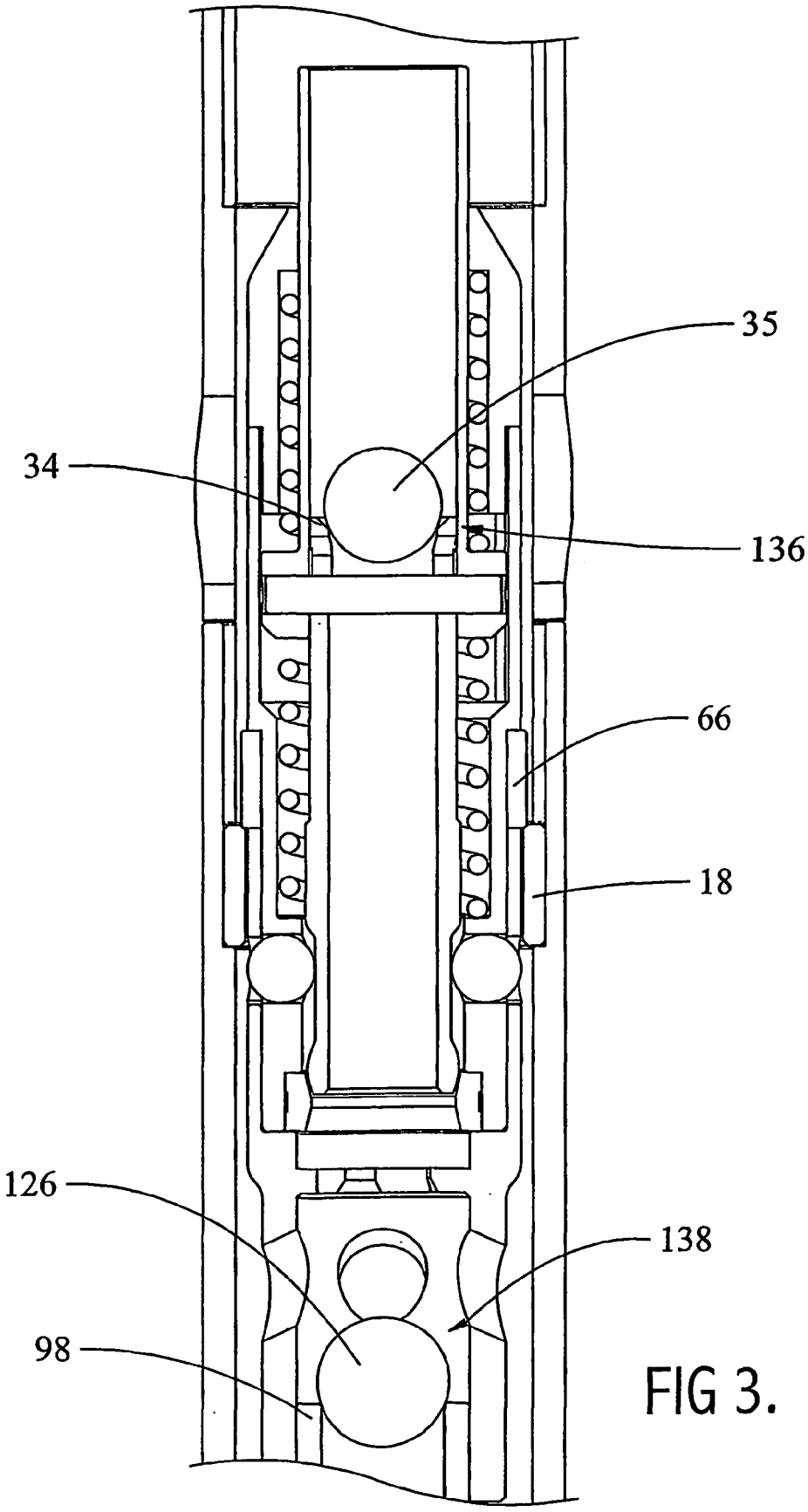
FIG. 3 is a view of the head assembly at the instant of landing on a landing ring in the drill string.

The descent of the assembly 10 is halted when the landing shoulder 66 abuts the landing ring 18, as depicted in FIG. 3. At ground level, this would be indicated to an operator by a reduction in the load or tension on the wire line at which point the wireline and overshot are withdrawn to the surface. The release surface 32 remains radially inside of the balls 26 and the balls 35 and 126 will, by action of gravity, drop on to the respective seats 34 and 98.

In order to latch the assembly 10 to the core barrel 20, the drill operator now commences pumping liquids such as water down the drill rod 14. This pumping action also assists in holding the balls 35 and 126 on to their respective seats thereby shutting the corresponding valves 136, 138 and closing the internal axial passageway. The liquid being pumped down the drill rod enters the sleeve 72. This liquid also assists in shutting the valve 136 by forcing the ball 35 on to the seat 34. As the pressure and weight of the water builds up, the sleeve 28 slides axially in the downstream direction within the upper latch body 24. Eventually, the tapered surface 38 comes into contact with the balls 26 causing them to ride onto the latching surface 30. This forces the balls 26 radially outwardly and into the latch seat 12. In addition, the downstream end 42 of the sleeve 28 pushes through the detent ring 62. The detent formed by the combination of the detent ring 62 and the downstream end 42 is arranged so that the force required for the end 42 to pass through the ring 62 is greater than the force supplied by the spring 82. This configuration is depicted in FIG. 4 which represents the latching position of the assembly 10.

The increase in fluid pressure within the drill rod 14 would be indicated to an operator in a conventional manner by way of both a pressure gauge and also the opening of a blow off valve when the water pressure exceeds a predetermined maximum. This also provides a visual indication of the positive latching of the assembly 10 to the core barrel 20.

When the increase in pressure is detected, the operator then turns off the pump relieving the pressure on the assembly 10, and in particular the ball 35 and corresponding valve 136. When this occurs, the spring 82 pushes the sleeve 72 axially in the upstream direction, causing the pin 78 to travel through the slots 36 to eventually abut the ball 35, lifting it off the seat 34 thereby opening the valve 136. This is depicted in FIG. 5 and represents the steady state or operational configuration of the assembly 10.

When it is required to withdraw the assembly 10, for example to empty the core barrel 102, an overshot is lowered through the drill rod 14 to engage with a spearhead coupled to the upstream end of the sleeve 72. The wire line is then reeled in. As this occurs, an upward force is imparted to the sleeve 72 and subsequently to the sleeve 28 via the pin 78.

This causes the sleeve 28 to move axially in the upstream direction relative to the upper latch body 24 to a position where the release surface 32 is now radially adjacent the balls 26. Accordingly, the balls 26 can move radially inwardly away from the latch seat 12 either by virtue of the resilience of the retaining ring 68 (if the ring 68 is made from a resilient material) or alternately, or in combination, by virtue of the abutment of the balls 26 with the landing ring 18 as the assembly 10 is being pulled upwardly by the wire line (see FIG. 6). Also in this configuration the pin 78 remains in contact with the ball 35 holding it off the seat 34. Thus, any column of water above the assembly 10 is able to flow through the inner axial passage and in particular, through the sleeves 72, 28, bypass seat 94 and out the port 92 of the lower latch body 90. This substantially increases the speed of ascent of the assembly 10 and reduces the load on the wire line as the assembly 10 is able to be easily pulled through any column of water above the assembly 10.

It would be appreciated from the above description that the present embodiment of the inner core tube head assembly 10, in particular the latching arrangement, has substantial benefits and advantages over the prior art. In particular, the assembly 10 provides a positive indication of the latching of the assembly 10 to the drill rod 14 as this is accompanied by a sustained increase in water pressure which is indicated by a conventional water pressure gauge and/or the accompanying opening of a blow off valve. These indications remain until the operator turns off the pump delivering water down the drill rod 14. This is to be contrasted with transient or instantaneous movements of a pressure gauge which can be easily missed if not being constantly observed. Further, the valves 136 and 138 allow fluid to flow through the assembly 10 during the lowering and retrieval of the assembly 10 thereby increasing the rate of descent and ascent as well as reducing the load on the wire line during ascent. Further, the use of balls 26 in conjunction with the locking sleeve 28 as part of the latch assembly virtually eliminates the possibility of the latch jamming.

All modifications and variations in the embodiment that would be obvious to a person of ordinary skill in the art are deemed to be within the scope of the present invention the nature of which is to be determined from the above description.

The invention claimed is:

1. An inner core barrel head assembly for releasably latching in a latch seat provided in a drill string, said assembly comprising:

an upper hollow latch body;

a plurality of latching elements retained in said latched body;

a hollow locking sleeve disposed within said upper latch body, said locking sleeve having a latching surface of a first outer diameter and a release surface of a second outer diameter less than said first outer diameter, said locking sleeve axially moveable relative to said upper latch body between a locking position and a release position, said locking position characterised by said latching elements being in abutment with said latching surface forcing said latching elements to move radially outwards where said latching elements can engage said latch seat to lock said assembly to said drill string, and said release position characterised by said release surface juxtaposed radially inside of said latching elements to allow said latching elements to move radially inwards out of engagement with said latch seat;

an internal passage constituted in part by said hollow locking sleeve through which fluid can flow when said inner core barrel assembly is tripped through said drill string; and a first valve for opening and closing said internal passage, said first valve comprising a first moveable stop located in the internal passage and a first seat formed on an up hole end of the locking sleeve wherein the first moveable stop closes the internal passage when seated on the first seat to block flow of fluid in a down hole direction.

2. The assembly according to claim 1 further comprising a detent for releasably holding said locking sleeve in said locking position.

3. The assembly according to claim 2 wherein said detent comprises a resilient ring through which said locking sleeve can be selectively pushed and pulled.

4. The assembly according to claim 1 further comprising a hollow release sleeve slidably coupled to said locking sleeve to enable said release sleeve and locking sleeve to move axially relative to each other for a first distance.

5. The assembly according to claim 4 wherein said hollow release sleeve forms part of said internal passage.

6. The assembly according to claim 4 further comprising a coupling member extending radially through said locking sleeve and engaged with said release sleeve.

7. The assembly according to claim 6 wherein one of said locking sleeve and release sleeve is provided with a pair of axially extending slots through which said coupling member passes.

8. The assembly according to 1 further comprising a first spring disposed about an outer surface of the locking sleeve and inside of the upper latch body, the first spring urging the first moveable stop in an up hole direction from the first seat thereby biasing the first valve toward the open position.

9. The assembly according to claim 8 wherein said first spring urges said coupling member in an up hole direction to lift said stop from said first seat.

10. The assembly according to claim 7 further comprising a lower latch body coupled between said upper latch body and a core tube, said lower latch body provided with an axial bore which forms part of said inner axial passage and a second valve operable for opening and closing said bore.

11. The assembly according to claim 10 wherein said second valve includes a second moveable stop, a second seat and a bypass seat, the bypass seat being up hole of the second seat and the second moveable stop being located in the lower latch body between the bypass seat and the second seat, wherein when said second stop is seated on said bypass seat fluid can flow in an up hole direction about said second stop and through said bypass seat, and when the second stop is seated on the second seat fluid is blocked from flowing there past in a down hole direction through the lower latch body.

12. The assembly according to claim 1 further comprising a retaining ring about an outer surface of said upper latch body through which said latching elements can partially extend.

13. The assembly according to claim 1 wherein said latch elements are in the form of balls.

14. The assembly according to claim 1 wherein said latching seat includes a tapered outer surface portion between said latching surface and said release surface.

* * * * *